US007086795B2

(12) United States Patent
Burdenko

(10) Patent No.: US 7,086,795 B2
(45) Date of Patent: Aug. 8, 2006

(54) ROLLER ASSEMBLY

(75) Inventor: Michael N. Burdenko, Wellesley, MA (US)

(73) Assignee: Zink Imaging, LLC, Waltham, MA (US)

( * ) Notice: Subject to any disclaimer, the term of this patent is extended or adjusted under 35 U.S.C. 154(b) by 0 days.

(21) Appl. No.: 11/215,682

(22) Filed: Aug. 29, 2005

(65) Prior Publication Data

US 2005/0286959 A1 Dec. 29, 2005

Related U.S. Application Data

(63) Continuation of application No. 10/743,235, filed on Dec. 22, 2003, now abandoned.

(60) Provisional application No. 60/436,277, filed on Dec. 23, 2002.

(51) Int. Cl.
*B41J 11/02* (2006.01)

(52) U.S. Cl. ..... 400/648; 400/55; 400/58; 400/649; 400/650; 347/108

(58) Field of Classification Search ..... 400/55, 400/56, 57, 58, 59, 648, 649, 650; 347/108; 492/18

See application file for complete search history.

(56) References Cited

U.S. PATENT DOCUMENTS

| | | | | |
|---|---|---|---|---|
| 4,979,835 | A * | 12/1990 | Beck et al. | 400/59 |
| 5,005,026 | A * | 4/1991 | Sakai | 347/197 |
| 5,481,290 | A * | 1/1996 | Watanabe et al. | 347/104 |
| 5,541,635 | A * | 7/1996 | Wills et al. | 347/197 |
| 5,725,317 | A * | 3/1998 | Gonmori et al. | 400/58 |
| 5,865,545 | A * | 2/1999 | Kondo | 400/207 |
| 6,398,330 | B1 * | 6/2002 | Chua et al. | 347/8 |
| 6,646,667 | B1 * | 11/2003 | Favre et al. | 347/222 |
| 6,682,239 | B1 * | 1/2004 | Mori et al. | 400/649 |
| 2002/0136580 | A1 * | 9/2002 | Ansell et al. | 400/103 |
| 2002/0175987 | A1 * | 11/2002 | Campanini | 347/108 |

FOREIGN PATENT DOCUMENTS

| | | |
|---|---|---|
| JP | 11-147337 | 6/1999 |
| JP | 11 147337 | 6/1999 |
| JP | 1999-147337 A | 6/1999 |

* cited by examiner

*Primary Examiner*—Daniel J. Colilla
*Assistant Examiner*—Dave A. Ghatt
(74) *Attorney, Agent, or Firm*—Foley & Lardner LLP; Michel Morency; James F. Ewing

(57) ABSTRACT

There is described a roller assembly which may be utilized in a linear or serial printer. The roller assembly includes a platen roller including a central axle being exposed at opposing ends of the roller and a frame for mounting the platen at both exposed axle ends.

11 Claims, 1 Drawing Sheet

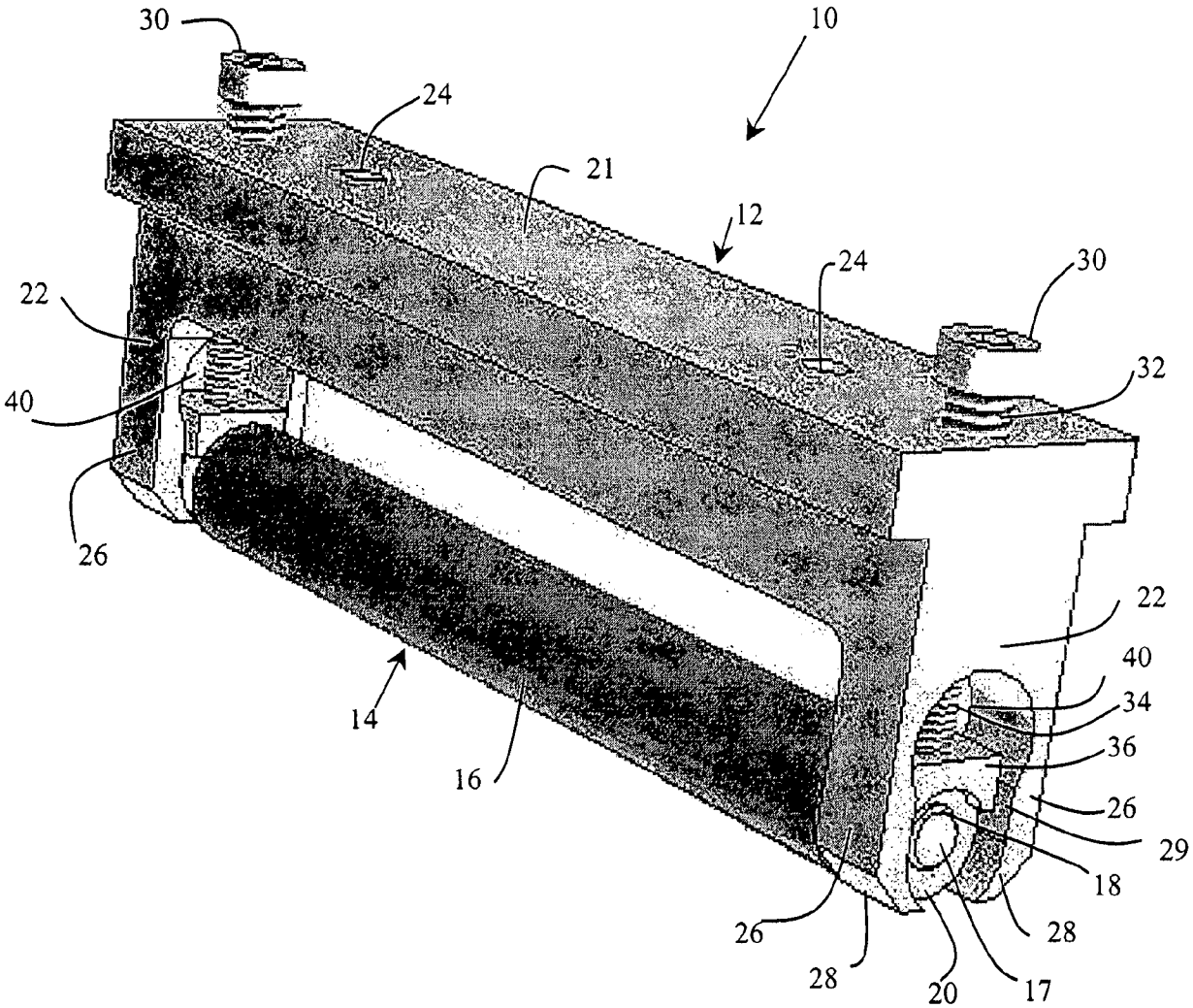
10
12
14
16
17
18
20
21
22
24
26
28
29
30
32
34
36
40

ROLLER ASSEMBLY

CROSS-REFERENCE TO RELATED APPLICATION

This is a continuation application of prior application Ser. No. 10/743,235, filed on Dec. 22, 2003 by Michael N. Burdenko and entitled ROLLER ASSEMBLY.

REFERENCE TO RELATED APPLICATIONS

This application claims the benefit of provisional application Ser. No. 60/436,277, filed Dec. 23, 2002.

TECHNICAL FIELD

The present invention relates to roller assemblies and particularly to roller assemblies, such as platen roller assemblies, having spring biased rollers.

BACKGROUND

Cylindrical rollers are widely used in a variety of apparatuses including linear or serial printers. One particular type of cylindrical roller is a platen roller, which is used to bias or support print media. Platen rollers are typically characterized by a relatively larger diameter roller section for providing a flatter foundation for the print media, and a relatively smaller diameter axle. In some applications, it is desirable for platen rollers to be movably mounted and biased for pressuring print media against a print head. Movement of such platen rollers needs to be free in certain directions and constrained in other directions.

SUMMARY OF THE INVENTION

The present invention relates to a roller assembly, comprising a platen roller including a central axle being exposed at opposite ends of the platen roller, and a frame for mounting the platen at both exposed axle ends. The frame includes a separate fork structure adapted for mounting each exposed axle end, with each fork structure being adapted to constrain a respective axle end from moving away from the frame. Also included is a bias mechanism cooperatively associated with each fork structure and being adapted to push the respective axle end away from the frame and against the fork structure and to allow movement of a respective axle end towards the frame and against the bias mechanism.

Each exposed axle end may include a bearing and the fork structure may be adapted to retain the bearing and to allow movement of the bearing directly towards the frame. The bias mechanism may include a bearing retainer which is biased away from the frame by the bias mechanism and adapted to engage the bearing.

Each fork structure may also be adapted to constrain the bearings from lateral movement with respect to the frame. Each fork structure may include a pair of members extending from the frame and adapted to extend around opposite sides of an axle end. Each pair of members of the fork structure may be separated by a first space having a sufficient size to allow a bearing to pass axially there through. Also, one fork structure of the frame may have an additional spacing between the pair of members which additional spacing is sufficiently large enough to allow the platen roller to pass axially there through. The first space and the additional spacing may be located proximally to the frame. The platen roller may be adapted to be assembled to the frame by passing the roller axially through the additional spacing of the one fork structure, passing a bearing through the first spacing between the other fork structure of the frame and installing the bias mechanisms in each fork structure to bias each axle end away from the frame.

The above variations provide a simplified roller assembly with a minimum number of parts, which may be assembled without the use of tools. This feature of the roller assembly is particularly important when it is necessary to make repairs in the field since the roller can be changed without having to be realigned with respect to the print head.

BRIEF DESCRIPTION OF THE DRAWING

For a better understanding of the invention as well as other objects and further features thereof, reference is made to the following detailed description of various preferred embodiments thereof taken in conjunction with the accompanying drawing wherein:

The FIGURE is a perspective view of a roller assembly.

DESCRIPTION OF THE PREFERRED EMBODIMENTS

The FIGURE shows a perspective view of a roller assembly 10, which generally includes a frame 12 and a platen roller 14. Roller 14 includes a cylindrical surface 16 and a central axle 17 having a pair of exposed ends 18. Each exposed end 18 has a bearing 20 mounted thereupon to allow each exposed end 18 to be mounted and enable low frictional rotation of central axle 17. Cylindrical surface 16 may be rubber coated as shown.

Frame 12 includes a main body 21 and a pair of fork structures 22 mounted on opposing ends of main body 21. Frame 12 may be mounted by means of a pair of holes 24, which may be threaded. Each fork structure 22 includes a pair of members 26, which extend away from the main body 21 like tines on a fork. Member 26 includes a distal end 28 which is adapted, in cooperation with the distal end of fellow fork member 26, to constrain a bearing 20 from moving away from frame 12 and main body 21. The distal ends 28 of each respective fork structure 22 may even be connected; however, the lack of connection provides a lower profile for clearing print media handled by platen roller 14.

Each bearing 20 is biased away from frame 12 and main body 21 by a cylindrical bias mechanism 30 to allow good conformance, for example, to a mating print head. The present bias mechanisms 30 each includes an adjustment screw section 32, a spring bias mechanism 34, and a bearing retainer 36. The inwardly facing sides 29 of fork members 26 are shaped to constrain the bearings 20 and bearing retainers 36 from moving laterally with respect to frame 12. The inwardly facing sides 29, bearings 20 and retainer 36 may be very accurately fabricated to substantially eliminate such lateral movement. Bearings 20 and bearing retainers 36 are allowed to move towards main body 21 of frame 12, which is also the axial direction of cylindrical bias mechanisms 30.

The stiffness of spring bias mechanism 34 can be sufficient to maintain roller 14 in its desired position and prevent it from moving laterally. In a preferred embodiment, bearing retainer 36 is provided with two shoulders (not shown) to prevent the roller 14 from moving laterally to contact the inner surfaces of fork member 26. The shoulders of the retainer extend over, and contact and slide along, the inner surfaces of fork member 26.

Each adjustment screw section 32 may be turned to create the desired amount of pressure from spring bias mechanism 34 on bearing retainer 36. The separate bias mechanisms 30 on a single frame 12 may be set to apply the same or different pressures depending upon the application. In this manner, bearing roller 14 may be set up to provide the desired amount of pressure against a print head. Assembly 10 thereby provides an independent suspension to each end of axle 17, which enables roller 14 significant freedom of movement for conforming to the application.

Bearing 20 is shaped like a ball bearing; however any suitable bearing may be used depending upon the application. Higher speed rotation may require a ball bearing, whereas lower speed rotation may be handled by a sleeve bearing. A suitable sleeve bearing may be provided by fabricating the current bearing 20 and bearing retainer 36 as a single piece.

Although bias mechanisms 30 are set up to bias bearings 20, the present structure may also be used without allowing such movement for bearings 20, depending upon the application Also adjustment screw sections 32 may be tightened to create sufficient pressure against bearing retainers 36.

Also, the current disclosure is not intended to be limited to platen rollers and may be applied to any suitable application, and especially to those requiring pressure and position adjustment for the roller.

Construction of the current assembly is simple and does not require any assembly tools. Each fork structure 22 includes sufficient space 40 between its respective members 26 to allow a bearing 20 to pass there between during the assembly process of roller assembly 10. At least one of the spaces 40 for each assembly 10 further includes additional space for allowing roller surface 16 to also pass between the respective members 26 of at least one fork structure 22. Spaces 40 are located proximally to frame 12 or main body 21.

The above described spacing, along with the other design features of roller assembly 10, significantly reduces the complexity of constructing assembly 10. Bearings 20 are first pressed upon exposed axle ends 18. Then roller 14 is at least partially inserted through a space 40 which is large enough to accommodate roller surface 16. Then, each bearing 20 is passed through a space 40 of a respective pair of members 26 and is pushed away from frame 12 or main body 21 and against the distal ends 28 of members 26. This is followed by the installation of bearing retainers 36 and the remainder of bias mechanisms 30. Adjustment screw sections 32 are then adjusted to create the proper amount of pressure against bearings 20 to retain the roller 14 within assembly 10. In this manner, assembly 10 maybe the easily and efficiently assembled.

The roller assembly of the invention may be incorporated in any thermal printer apparatus. In a preferred embodiment, at least one such roller assembly is incorporated in the thermal printer apparatus disclosed and claimed in commonly assigned U.S. patent application Ser. No. 10/743,235, filed on even date herewith the entire disclosure of which is hereby incorporated by reference herein.

Although the invention has been described in detail with respect to various preferred embodiments it is not intended to be limited thereto, but rather those skilled in the art will recognize that variations and modifications are possible which are within the spirit of the invention and the scope of the appended claims.

What is claimed is:

1. A roller assembly, comprising:

a platen roller including a central axle being exposed at opposite ends of said platen roller;

a frame for mounting said platen roller at both exposed axle ends;

said frame including a main body and a plurality of fork structures adapted for mounting each exposed axle end;

each said fork structure being adapted to constrain a respective axle end from moving away from said frame; and a plurality of bias mechanisms, each said bias mechanism being operative independently of said other bias mechanism and each said bias mechanism being cooperatively associated with only one of said fork structures and being adapted to push said respective axle end away from said frame and against said fork structure.

2. The roller assembly of claim 1, wherein each said bias mechanism is adapted to allow movement of a respective axle end towards said main body of said frame and against said bias mechanism.

3. The roller assembly of claim 2, wherein each exposed axle end includes a bearing and further wherein each said fork structure is adapted to retain said bearing and to allow movement of the bearing directly towards the main body of said frame.

4. The roller assembly of claim 3, wherein said bias mechanism comprises a bearing retainer which is biased away from said main body of said frame by said bias mechanism and adapted to engage said bearing.

5. The roller assembly of claim 4 wherein said bearing retainer is adapted to constrain said bearings from lateral movement with respect to said frame.

6. The roller assembly of claim 3, wherein each said fork structure is adapted to constrain said bearings from lateral movement with respect to said frame.

7. The roller assembly of claim 6, wherein each said fork structure includes a pair of members extending from said frame and adapted to extend around opposite sides of a said bearing.

8. The roller assembly of claim 7, wherein each pair of members of said fork structure is separated by a first space having a sufficient size to allow a said bearing to pass axially therethrough.

9. The roller assembly of claim 8, wherein one said fork structure of said frame has an additional spacing between said pair of members which additional spacing is sufficiently large enough to allow said platen roller to pass axially therethrough.

10. The roller assembly of claim 9, wherein said first space and said additional spacing are located proximally to said frame.

11. The roller assembly of claim 10, wherein said platen roller is adapted to be assembled to said frame by passing said roller axially through said additional spacing of said one fork structure, passing a bearing through said first spacing between another said fork structure of said frame and installing said bias mechanisms in each fork structure to bias an axle end towards a respective fork structure.

* * * * *